US005772477A

United States Patent [19]

Cloarec et al.

[11] Patent Number: 5,772,477

[45] Date of Patent: Jun. 30, 1998

[54] ELECTRICAL CONNECTOR

[75] Inventors: Sylvain Cloarec, Viroflay; Fabrice Durand-Cochet, Rambouillet, both of France

[73] Assignee: Connecteurs Cinch, Montigny Le Bretonneaux, France

[21] Appl. No.: 684,180

[22] Filed: Jul. 19, 1996

[30] Foreign Application Priority Data

Aug. 22, 1995 [FR] France ..... 95 09984

[51] Int. Cl.[6] ..... H01R 13/436

[52] U.S. Cl. ..... 439/752; 439/488

[58] Field of Search ..... 439/752, 595, 439/491, 488

[56] References Cited

U.S. PATENT DOCUMENTS

| | | | |
|---|---|---|---|
| 3,320,573 | 5/1967 | Machts et al. | 439/378 |
| 3,447,036 | 5/1969 | Dore et al. | 439/378 |
| 4,721,478 | 1/1988 | Sonobe | 439/752 |
| 4,804,341 | 2/1989 | Kato et al. | 439/733 |
| 4,867,711 | 9/1989 | Yuasa | 439/752 |
| 4,915,654 | 4/1990 | Zinn | 439/752 |
| 4,959,023 | 9/1990 | Watanabe et al. | 439/752 |
| 5,030,142 | 7/1991 | Hess et al. | 439/752 |
| 5,035,654 | 7/1991 | Endo | 439/679 |
| 5,122,080 | 6/1992 | Hatagishi et al. | 439/752 |
| 5,203,722 | 4/1993 | Kinoshita | 439/752 |
| 5,211,583 | 5/1993 | Endo et al. | 439/491 |
| 5,252,096 | 10/1993 | Okada | 439/752 |
| 5,356,317 | 10/1994 | Shinji | 439/752 |
| 5,368,492 | 11/1994 | Hayashi | 439/157 |

FOREIGN PATENT DOCUMENTS

| | | | |
|---|---|---|---|
| 3330151 | 3/1985 | Germany | 439/752 |
| 3705739 | 8/1987 | Germany . | |
| 4114931 | 11/1991 | Germany . | |
| 4325371 | 3/1994 | Germany . | |
| 2186748 | 8/1987 | United Kingdom . | |
| 2229584 | 9/1990 | United Kingdom . | |
| 8901247 | 2/1989 | WIPO | 439/752 |

*Primary Examiner*—Gary F. Paumen
*Attorney, Agent, or Firm*—Greenblum & Bernstein P.L.C.

[57] ABSTRACT

An electrical connector comprises a male member with conduits arranged in rows and in transverse lines and each designed to receive an electrical contact member. The electrical contact members are locked by a locking key mobile in the male member perpendicularly to the conduits and having slots corresponding to the rows. The key includes notches in the slots and disposed along the transverse lines. The male member and the key carry markers corresponding to the rows and to the transverse lines.

11 Claims, 8 Drawing Sheets

ELECTRICAL CONNECTOR

BACKGROUND OF THE INVENTION

1. Field of the Invention

The present invention concerns an electrical connector.

2. Description of the Prior Art

The invention is aimed at an electrical connector comprising a female member furnished with electrical contact members and a male member adapted to be inserted into the female member and incorporating complementary electrical contact members.

The invention is more particularly concerned with connectors in which the male member has a series of conduits arranged in rows and each receiving an electrical contact member having a shoulder part-way along its length, said male member having a channel perpendicular to the conduits in which a locking key having slots corresponding to the rows moves in such a manner as to lock the members, the shoulder on the latter bearing against the edges of the slots.

One drawback of an arrangement of this kind is that if one of the electrical contact members is faulty is cannot be replaced without withdrawing the key, with the attendant risk of the other members moving in the conduits.

One object of the present invention is to remedy this drawback.

SUMMARY OF THE INVENTION

The invention consists in an electrical connector comprising a female member including electrical contact members and a male member including electrical contact members complementary to those of the female member inserted in conduits of said male member disposed in rows and in transverse lines, wherein said complementary electrical contact members have a shoulder part-way along their length, said male member has a channel extending perpendicularly to the conduits, a locking key is guided in the channel and is formed by a flat plate having a series of slots that open onto a free end, said slots are disposed so as to be in line with the rows of conduits in order to oppose withdrawal of the complementary electrical contact members by cooperating with the shoulders thereof, each slot includes at least one notch part-way along its length, the notches are disposed to correspond to the transverse lines and have dimensions corresponding to those of the complementary electrical contact members so that the latter can be withdrawn from the conduits when the notches are in line therewith, the male member includes markers corresponding to the rows and to the transverse lines and the key is provided with corresponding markers so that, by withdrawing the key partially from the male member, a chosen row and a chosen line can easily be identified.

In accordance with one specific feature of the invention, the male member includes at least one transverse line of complementary electrical contact members larger than the others and the slots each have a cut-out corresponding to the size of said members.

In accordance with one structural feature, the transverse line of larger complementary electrical contact members is near a wall of the male member and the cut-outs are near the free end of the key.

In accordance with another structural feature, the key has along two edges parallel to the slots rims guided in slideways of the male member and including, at the same end as the free end of the key, an elastic lug having a hook adapted to cooperate with the shoulders of the male member, one of the shoulders corresponding to a locked position of the key and the other, in a withdrawn position of the key, opposing its withdrawal from the male member.

The slideways include notches corresponding to the various lines of conduits with which said hook can selectively cooperate. Accordingly the key can easily be locked in a position corresponding to a preselected row.

The electrical contact members of the female member are preferably formed by pins between which extend guide strips adapted to be inserted in housings of the male members. Accordingly, incorrect presentation of the male member in the female member is avoided, as this could damage the pins.

Finally, in accordance with one structural feature, the male member has a support body provided with a locking lever with cams adapted to cooperate with pins on the female member, the body is formed by a hollow member open at both ends and the support member is shaped to receive a module including the conduits and the locking key.

The invention will now be described in more detail, by way of example only and with reference to a particular embodiment shown in the appended drawings.

DETAILED DESCRIPTION OF THE PREFERRED EMBODIMENT

Figure 1:
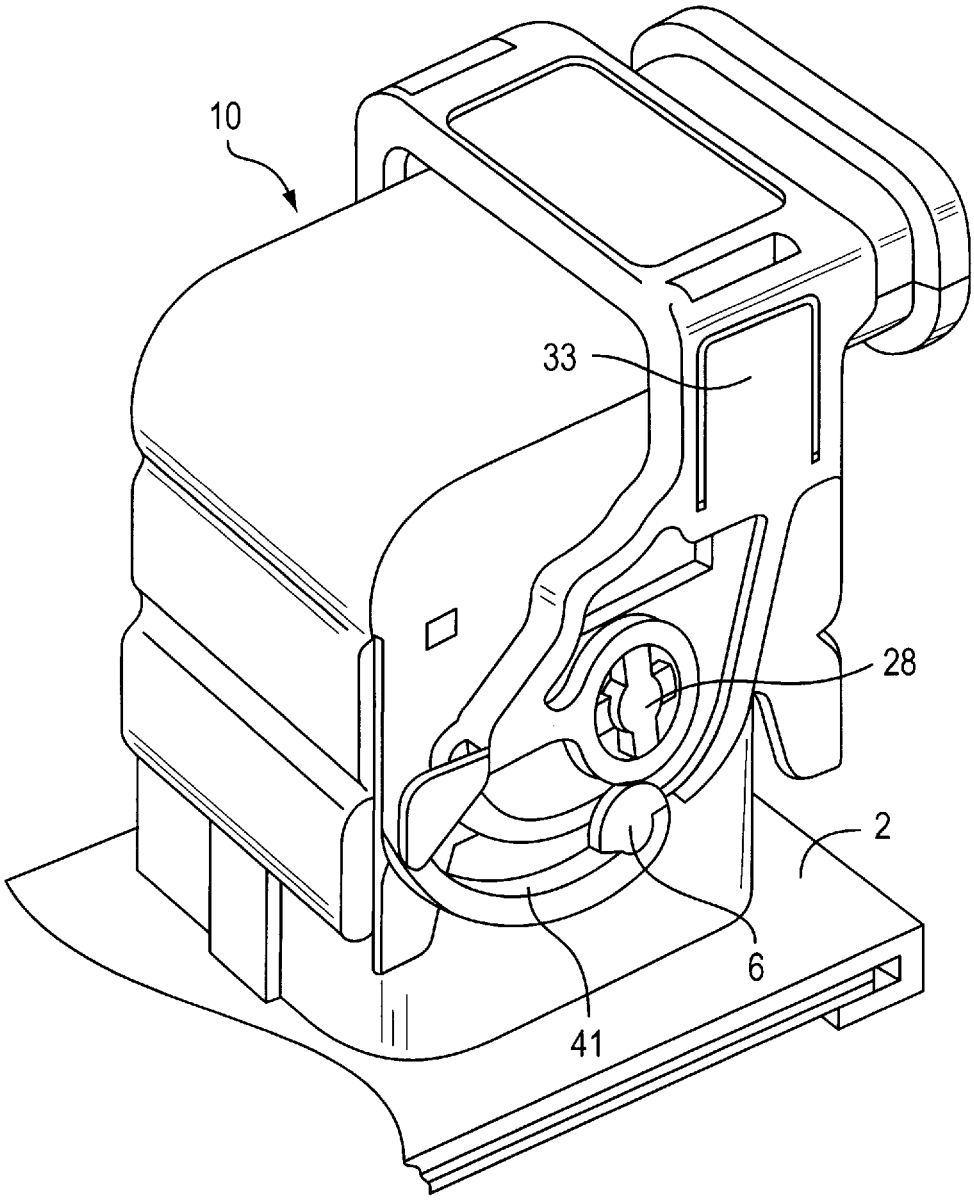
FIG. 1 is a perspective view of a connector of the invention.
Figure 2:
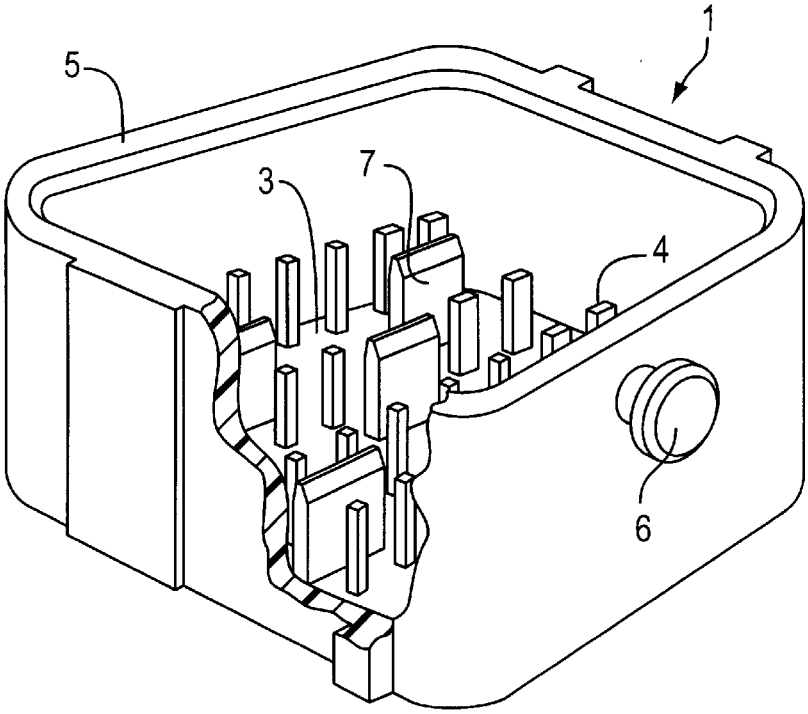
FIG. 2 is a partially cutaway perspective view showing the female member of the connector.

The connector shown in the figures comprises a female member 1 attached to a base 2 and a male member 10. The female member 1 has a back wall 3 carrying a series of upstanding male pins 4 connected to appropriate electrical circuits. The female member 1 has a lateral wall 5 with pins 6 on two opposite faces. Guide strips 7 attached to the back wall between the pins 4 center the corresponding male member when the latter is inserted in order to avoid incorrect presentation of the latter deforming said pins.

Figure 4:
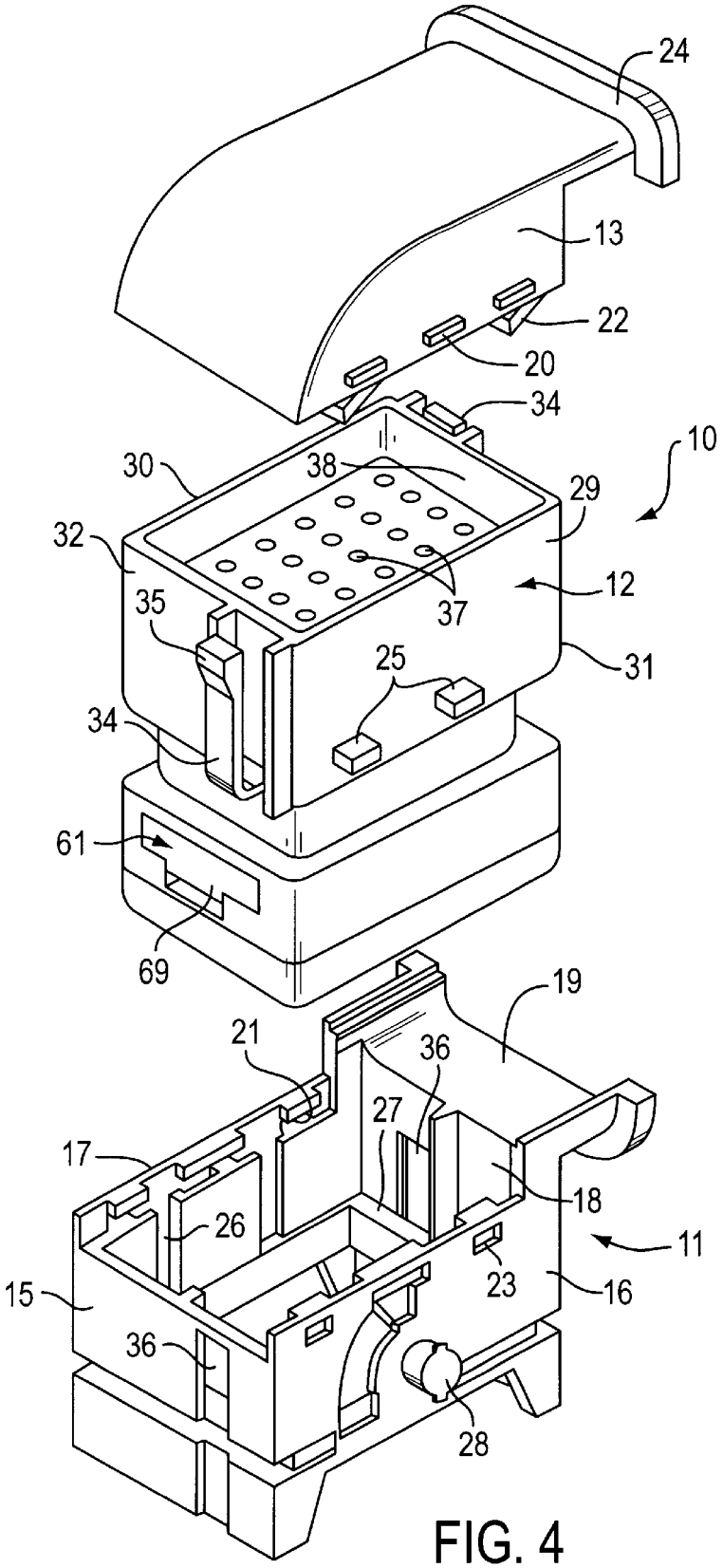
FIG. 4 is an exploded perspective view of the male member of the connector of the invention.
Figure 5:
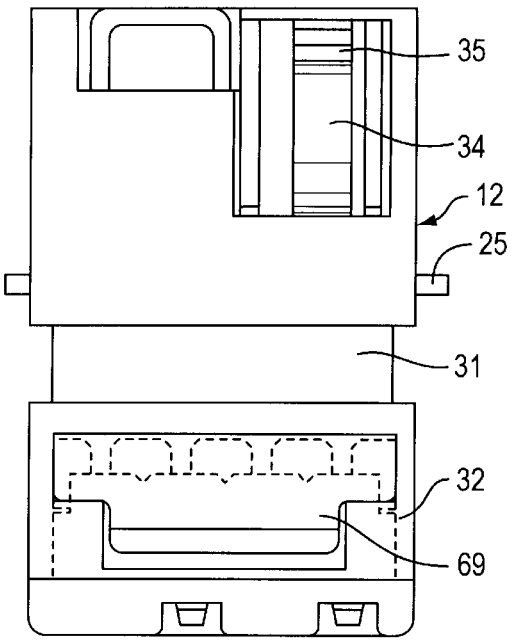
FIG. 5 is an end elevation view of the module of the male member.
Figure 6:
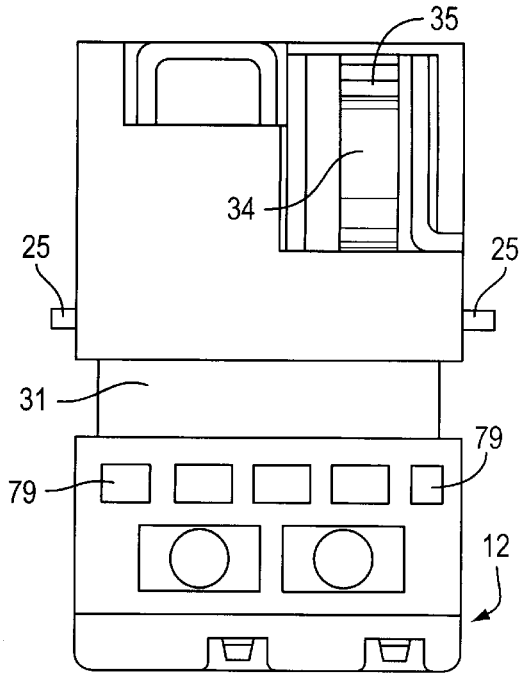
FIG. 6 is an end elevation view of the other end of the module from FIG. 5.
Figure 7:
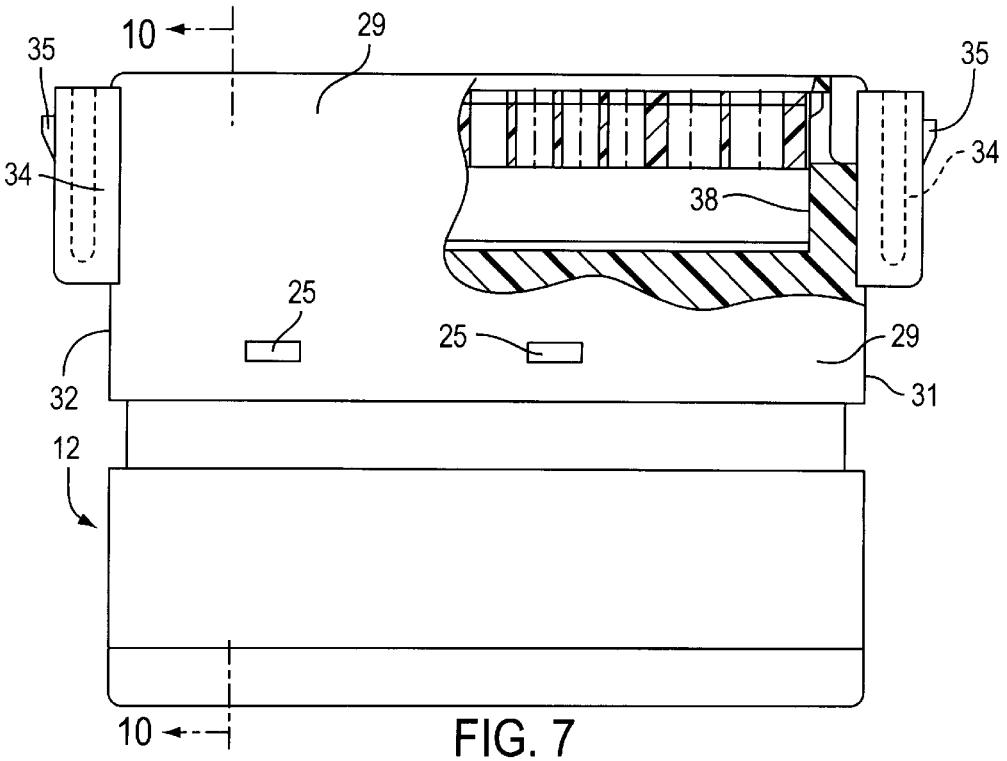
FIG. 7 is a side elevation view of the module from FIGS. 5 and 6.

The male member 10 (see FIG. 4) has a support body 11, a module 12 and a cover 13.

The support body 11 is a hollow member open at both ends with four lateral walls 15, 16, 17 and 18, the wall 18 being slightly higher and terminating in a half-shell 19 adapted to guide electrical conductors.

The cover 13 has lateral projections 20 adapted to cooperate with grooves 21 and lugs 22 adapted to be inserted in openings 23 in the walls 16 and 17 to lock the cover 13 to the body 11. The cover 13 terminates in a half-shell 24 complementary to the half-shell 19.

The body 11 has pins 28 on its walls 16 and 17 on which pivots a locking lever 33 having cams 41 cooperating with the pins 6.

The module 12 is designed to be inserted into the body 11 and has projections 25 on two opposite walls 29 and 30 that are inserted in grooves 26 and abut against a shoulder 27 of the body 11.

On two other opposite walls 31 and 32 the module 12 has resilient locking strips 34 with a lug 35 designed to be inserted into a corresponding hole 36 in the body 11.

A series of conduits 37 through the module 12 have insertion ends 40 opening onto a skirt 38 adapted to receive a seal 39. The conduits 37 are arranged in rows parallel to the walls 29 and 30 and in transverse lines parallel to the walls 31 and 32.

On the side opposite the insertion ends 40 the conduits 37 have an abutment 42 for retaining female electrical contact members 45.

Figure 3:
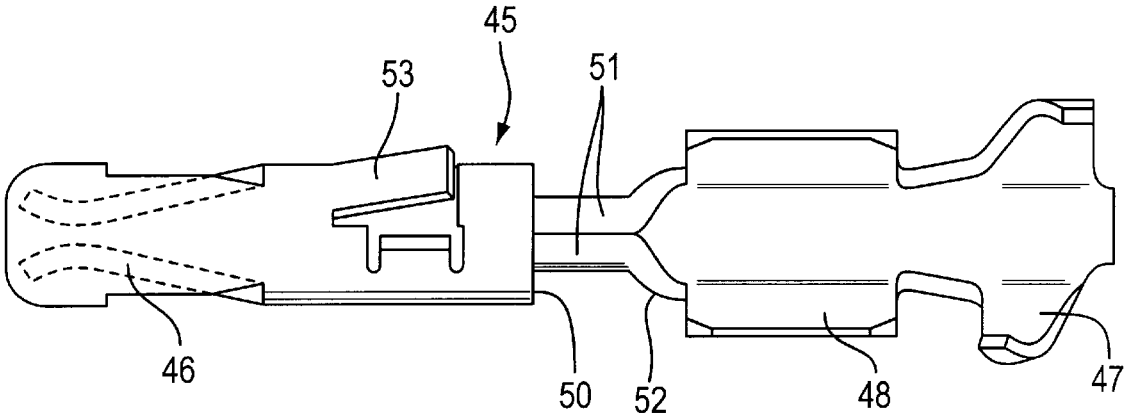
FIG. 3 is an elevation view of an electrical contact member designed to fitted to the connector of the invention.

The female electrical contact members (see FIG. 3) are complementary to the pins 4 and are made from a metal that is a good conductor of electricity and has some elasticity. They comprise an elongate body having at one end an elastic clamp 46 adapted to grip elastically a pin 4 and at the other end lugs 47 and 48 for crimping. it to an electrical conductor.

The body has a shoulder 50 joined to the part with the clamp 46 by a narrow part 51 and to the part with the lugs 47 and 48 by an outwardly flared portion 52.

A tang 53 is cut out from the part of the body including the clamp 46 and cooperates with the inside surface of the conduits 37 to constitute a brake.

The side of the module 12 facing towards the back wall 3 of the female member includes slots 56 through which the pins 4 pass and housings 57 in which the guide strips 7 are inserted.

In the module 12, a channel 60 in which slides a key 61 extends perpendicularly to the conduits 37 from the face 32 to the face 31.

Figure 14:
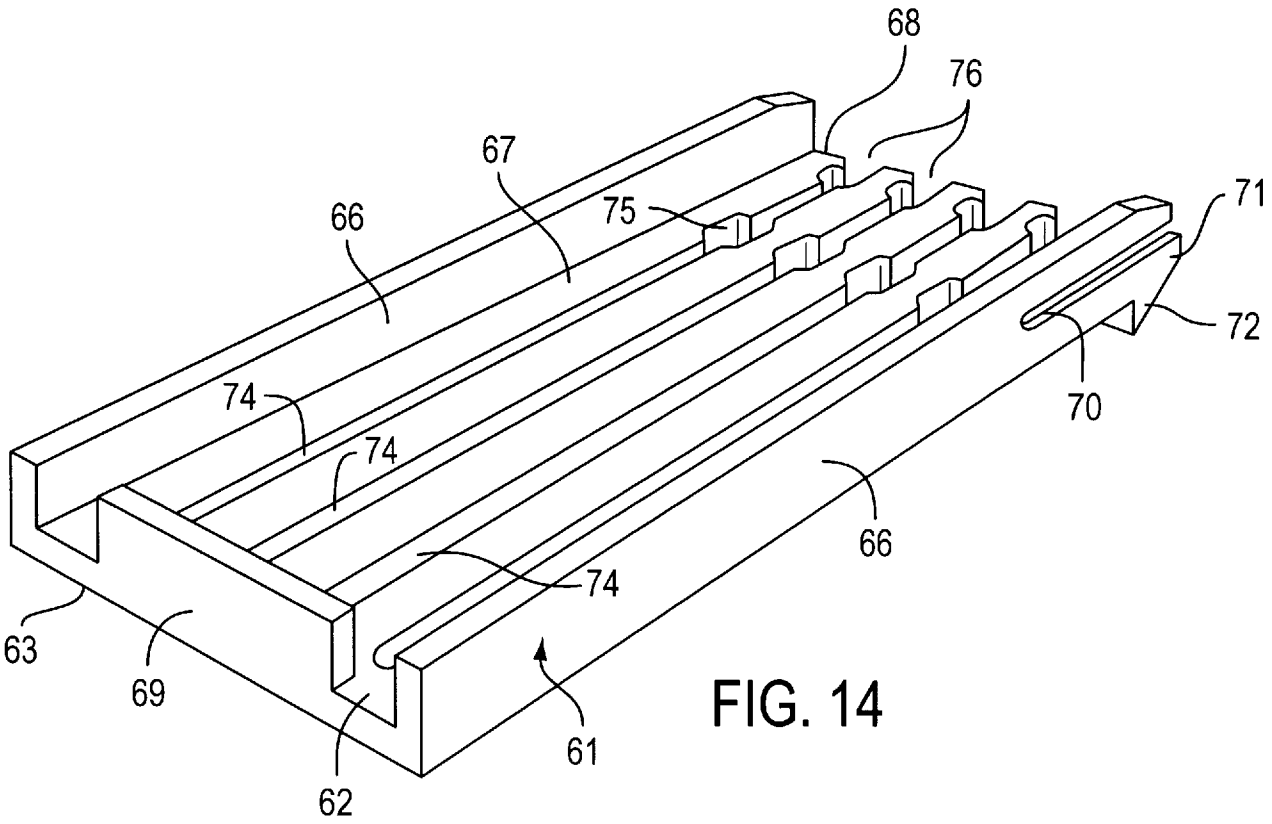
FIG. 14 is a perspective view of a key for locking a module.

The key 61 (see FIG. 14) is a flat plate with two faces 62 and 63 and two rims 66 along two longitudinal edges on the same side as the face 62.

Slots 67 in the key 61 parallel to the rims 66 open onto a free edge 68.

A handling tab 69 is provided on the face 62, on the side opposite the free edge 68, and at the same end as the free edge 68 the rims 66 have a slot 70 which forms an elastic strip 71 on the same side as the face 63 with a hook 72 on the same side as said face 63. The face 62 of the key 61 includes ribs 74 between the slots 67.

There is a notch 75 part-way along each slot 67 and a cut-out 76 larger than the notch 75 near the free edge 68.

Figure 12:
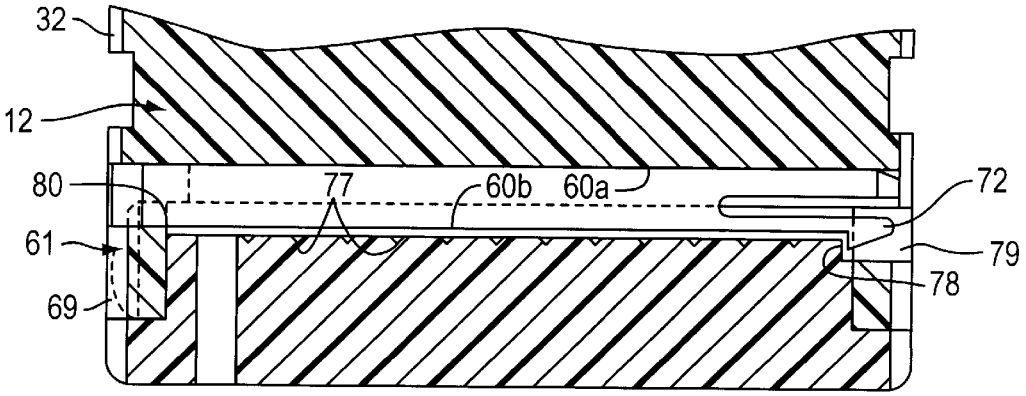
FIG. 12 is a view in section on the line 12—12 in FIG. 11.
Figure 13:
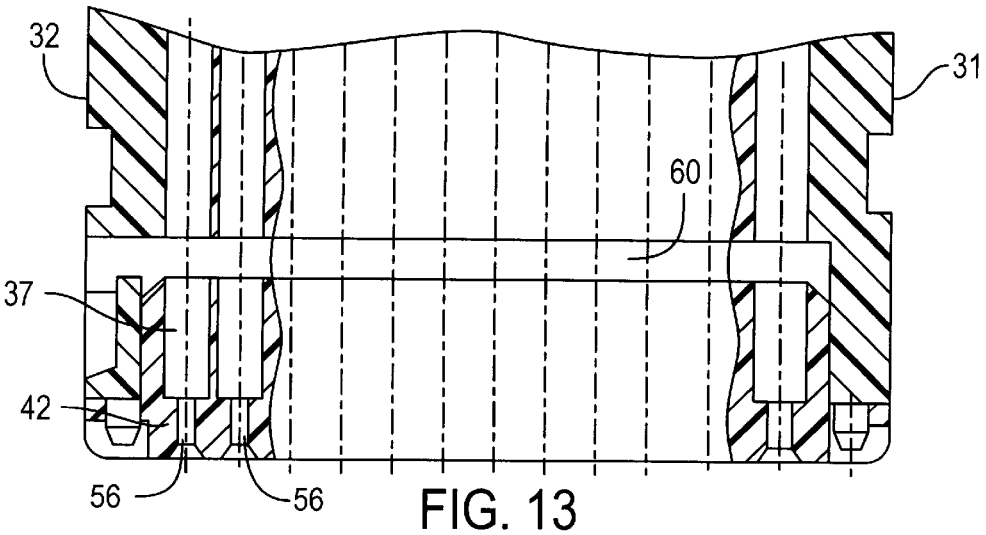
FIG. 13 is a view in section on the line 13—13 in FIG. 11.

The channel 60 is shaped to receive and guide the key 61 and has slideways 60*a* at the sides in which the rims 66 are guided, said slideways opening into openings 79 having a shoulder 78 with which the hook 72 cooperates in a locked position of the key (see FIG. 12). Along their edge 60*b* the slideways 60*a* have notches 77 with which the hooks 72 selectively cooperate, an abutment 80 being provided on the same side as the wall 32 so that the key 61 cannot be withdrawn once it has been fitted.

Figure 9:
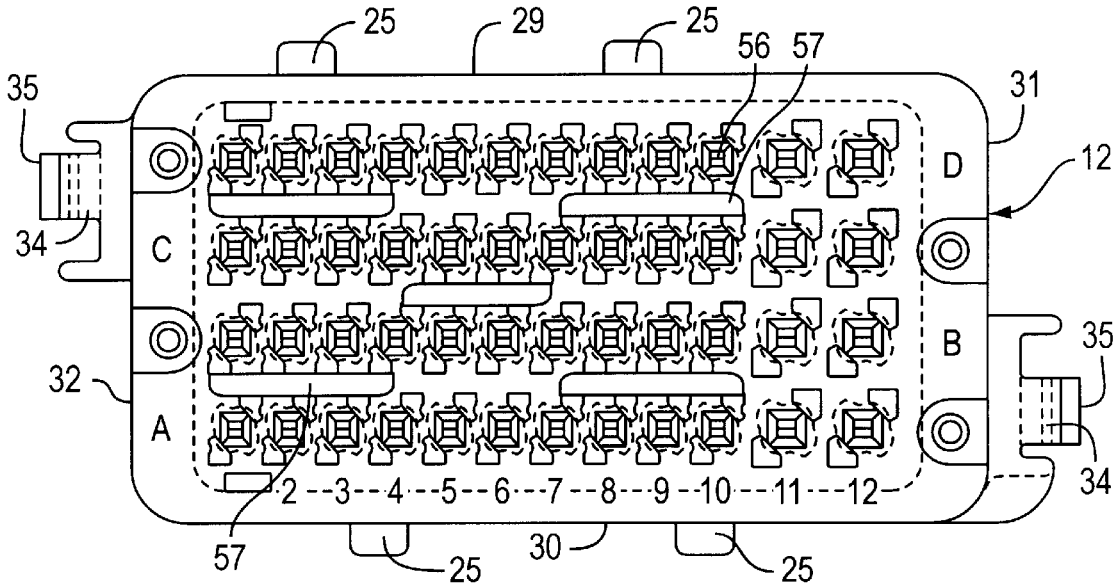
FIG. 9 is a bottom view of the module from FIGS. 6 through 8.
Figure 10:
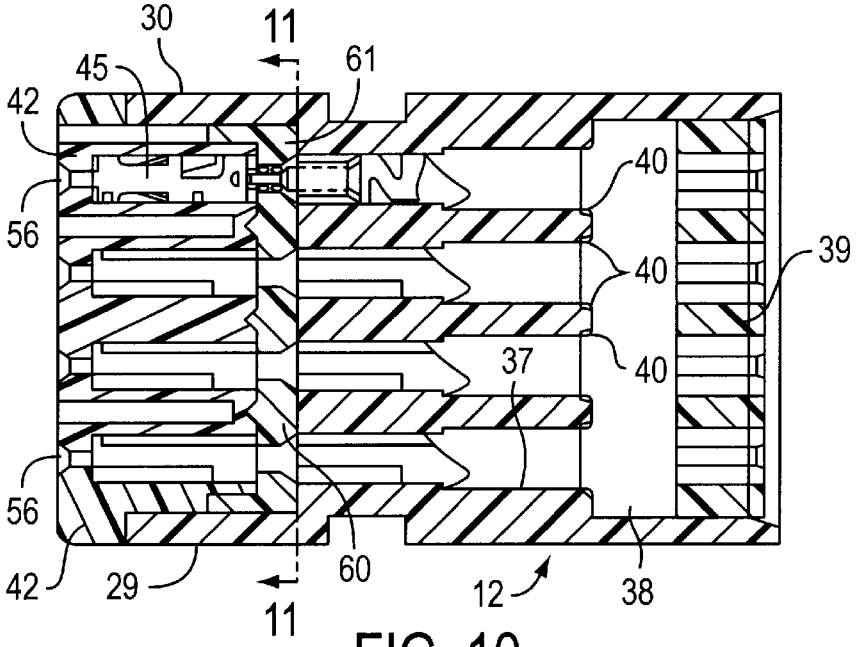
FIG. 10 is a view in section on the line 10—10 in FIG. 7.
Figure 11:
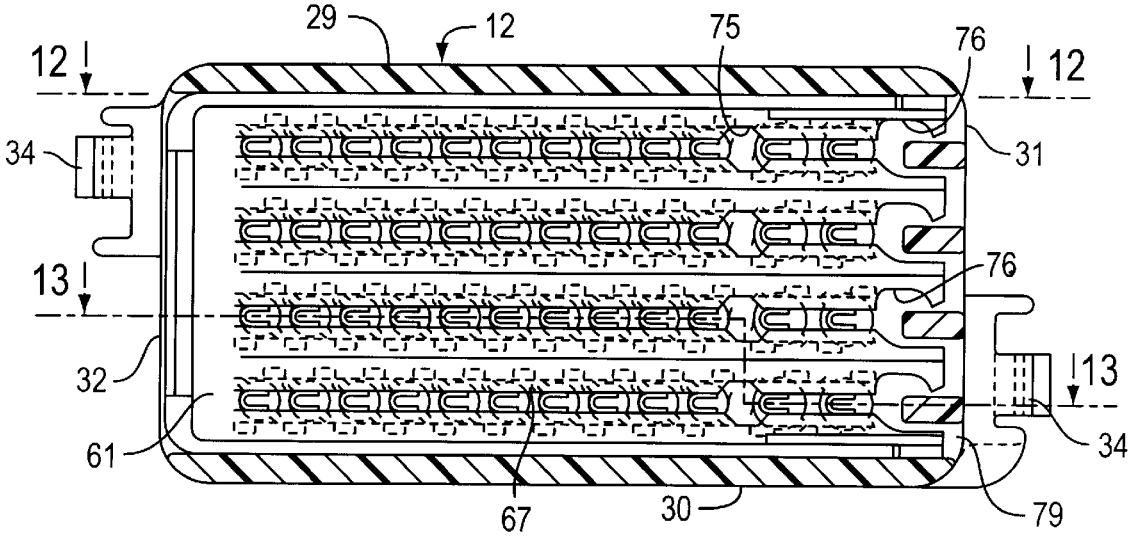
FIG. 11 is a view in section on the line 11—11 in FIG. 10.

The end of the module with the slots 56 (see figure 9) includes markers formed by the letters A B C D corresponding to the four longitudinal rows of the conduits 37 and the numbers 1 through 12 corresponding to the twelve transverse lines of conduits 37.

Note that the conduits 37 of the transverse lines 11 and 12 are wider than the others, being adapted to receive electrical contact members that are larger than the other members, the corresponding pins 4 being also larger than the other pins.

Figure 8:
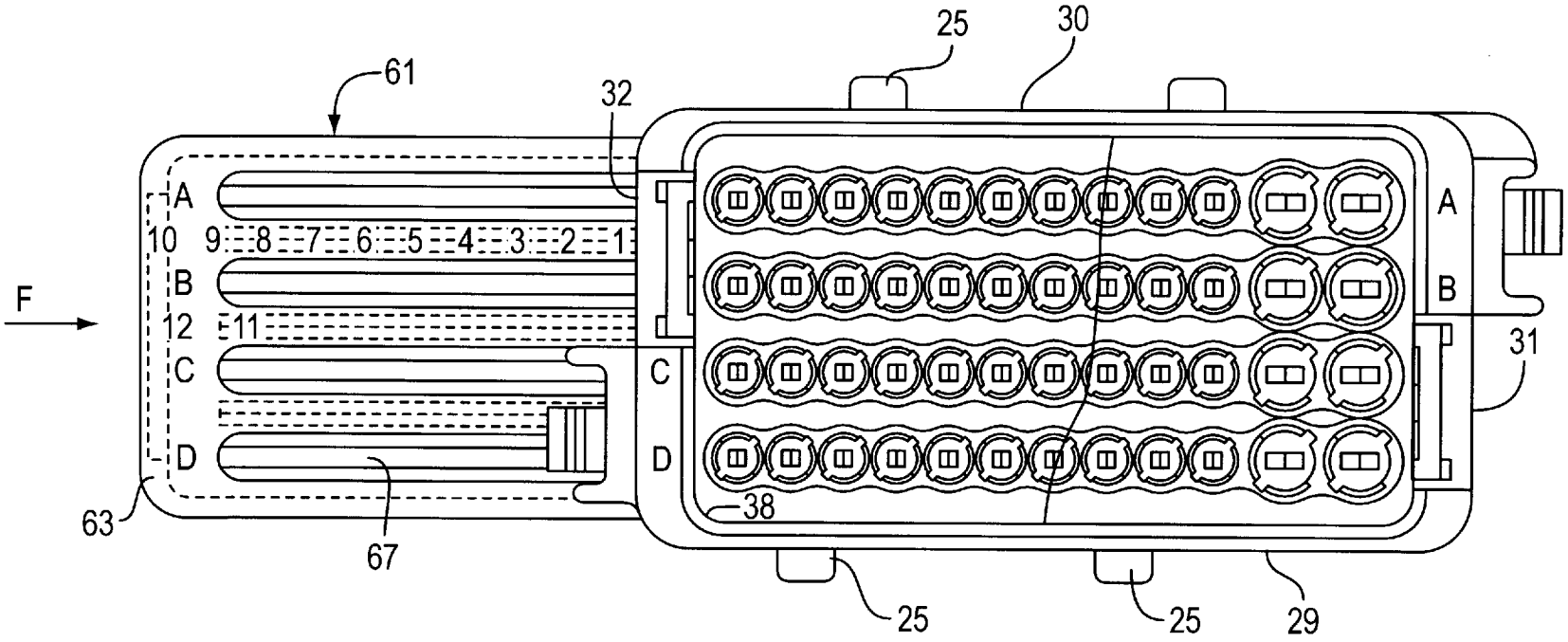
FIG. 8 is a top view of the module from FIGS. 5 through 7.

The face 63 of the key 61 (see FIG. 8) includes markers formed by the letters A B C D corresponding to the slots 67 corresponding to the longitudinal rows A B C D, the numbers 10 through 1 between the slots (67) corresponding to the rows A and B and, finally, markers 12 and 11 between the slots 67 corresponding to the rows B and C.

The notches 77 each correspond to one transverse line of conduits 37. Accordingly, when the hooks 72 are in a notch 77, the key being partly disengaged and the number 3 (for example) appearing along the wall 32, the notches 75 face the line of conduits 37 in line with the number 3 and the electrical contact members 45 of that line can be withdrawn from the conduits 37.

The number 11 on the key 61 indicates a position of the latter in which the hooks 72 are in the notches 77 that correspond to a position in which the cut-outs 76 are in line with the transverse line of conduits 37, enabling the corresponding members 45 to be withdrawn from that line. The number 12 indicates that it is possible to withdraw the members 45 of that line. These two lines of electrical contact members being larger than the others, the cut-outs 76 are larger than the notches 75.

The key 61 can be locked only if the members 45 are correctly in place and the module 12 can only be mounted in the body 10 if the key is locked.

Because of the marker system, the key 61 can very easily be moved to a position enabling replacement of a faulty electrical contact member 45 with another, without it being necessary to withdraw said key and without any risk of the other members 45 moving in the conduits 37.

Note that the notches 75 and the cut-outs 76 have a cross-section that corresponds to the cross-section of the conduits 37 so that when a female electrical contact member 45 is withdrawn from a conduit 37 the notch or the cut-out is continuous with the cross-section of the conduit, which prevents the free end of the tang 53 abutting against the edge of the part of the conduit 37 opening into the channel 60 opposite the retaining abutment 42.

The invention is naturally not limited to the embodiment as described and shown. Many modifications of detail may be made thereto without departing from the scope of the invention.

There is claimed:

1. Electrical connector comprising a female member including electrical contact members and a male member including electrical contact members complementary to those of the female member inserted in conduits of the male member disposed in rows and in transverse lines, wherein said complementary electrical contact members have a shoulder part-way along their length, said male member has a channel extending perpendicularly to said conduits, a locking key being guided in said channel and is formed by a flat plate having a series of slots that open onto a free end, said slots are disposed so as to be in line with said rows of conduits in order to oppose withdrawal of the complementary electrical contact members by cooperating with shoulders thereof, each slot includes at least one notch part-way along its length, said notches are disposed to correspond to said transverse lines and have dimensions corresponding to those of said complementary electrical contact members so that the latter can be withdrawn from said conduits when the notches are in line therewith, said male member includes row markers and transverse line markers, each row marker identifying a respective row and each transverse line marker identifying a respective transverse line, and said key is provided with corresponding row markers and transverse line markers, each row marker identifying a respective row and each transverse line marker identifying a respective transverse line, so that, by withdrawing said key partially from said male member, the row and the chosen transverse line can easily be identified, the chosen transverse line being aligned with the notches.

2. Electrical connector according to claim 1 wherein said male member includes at least one transverse line of complementary electrical contact members larger than the others and said slots each have a cut-out corresponding to the size of said larger members.

3. Electrical connector according to claim 2 wherein said transverse line of larger complementary electrical contact members is near a wall of said male member and said cut-outs are near said free end of said key.

4. Electrical connector according to claim 1 wherein said key has along two edges parallel to said slots rims guided in slideways of said male member and including, at the same end as said free end of said key, an elastic lug having a hook adapted to cooperate with said shoulders of said male members, one of said shoulders corresponding to a locked position of said key and the other, in a withdrawn position of said key, opposing its withdrawal from said male member.

5. Electrical connector according to claim 1 wherein said electrical contact members of said female member are formed by pins between which extend guide strips adapted to be inserted in housings of said male member.

6. Electrical connector according to claim 1 wherein said male member has a support body provided with a locking lever with cams adapted to cooperate with pins on said female member, said body is formed by a hollow member open at both ends and said support member is shaped to receive a module including said conduits and said locking key.

7. Electrical connector comprising a female member including electrical contact members and a male member including electrical contact members complementary to those of the female member inserted in conduits of the male member disposed in rows and in transverse lines, wherein said complementary electrical contact members have a shoulder part-way along their length, said male member has a channel extending perpendicularly to said conduits, a locking key being guided in said channel and is formed by a flat plate having a series of slots that open onto a free end, said slots are disposed so as to be in line with said rows of conduits in order to oppose withdrawal of the complementary electrical contact members by cooperating with shoulders thereof, each slot includes at least one notch part-way along its length, said notches are disposed to correspond to said transverse lines and have dimensions corresponding to those of said complementary electrical contact members so that the latter can be withdrawn from said conduits when the notches are in line therewith, said male member includes row markers and transverse line markers, each row marker identifying a respective row and each transverse line marker identifying a respective transverse line, and said key is provided with corresponding row markers and transverse line markers, each row marker identifying a respective row and each transverse line marker identifying a respective transverse line, so that, by withdrawing said key partially from said male member, the row and the chosen transverse line can easily be identified, the chosen transverse line being aligned with the notches, wherein said key has along two edges parallel to said slots rims guided in slideways of said male member and including, at the same end as said free end of said key, an elastic lug having a hook adapted to cooperate with said shoulders of said male member, one of said shoulders corresponding to a locked position of said key and the other, in a withdrawn position of said key, opposing its withdrawal from said male member, wherein said slideways include notches corresponding to the various lines of conduits with which said hook can selectively operate.

8. Electrical connector according to claim 7 wherein said male member includes at least one transverse line of complementary electrical contact members larger than the others and said slots each have a cut-out corresponding to the size of said larger members.

9. Electrical connector according to claim 8 wherein said transverse line of larger complementary electrical contact members is near a wall of said male member and said cut-outs are near said free end of said key.

10. Electrical connector according to claim 7 wherein said electrical contact members of said female member are formed by pins between which extend guide strips adapted to be inserted in housings of said male member.

11. Electrical connector according to claim 7 wherein said male member has a support body provided with a locking lever with cams adapted to cooperate with pins on said female member, said body is formed by a hollow member open at both ends and said support member is shaped to receive a module including said conduits and said locking key.

* * * * *